US008151617B2

(12) United States Patent
Feng et al.

(10) Patent No.: US 8,151,617 B2
(45) Date of Patent: Apr. 10, 2012

(54) TURBULIZERS AND METHOD FOR FORMING SAME

(75) Inventors: Yi Feng, Mississauga (CA); Peter Zurawel, Mississauga (CA); Ray Caron, Burlington (CA)

(73) Assignee: Dana Canada Corporation, Oakville, Ontario (CA)

( * ) Notice: Subject to any disclaimer, the term of this patent is extended or adjusted under 35 U.S.C. 154(b) by 335 days.

(21) Appl. No.: 12/469,783

(22) Filed: May 21, 2009

(65) Prior Publication Data

US 2010/0230085 A1 Sep. 16, 2010

Related U.S. Application Data

(63) Continuation-in-part of application No. 12/126,695, filed on May 23, 2008.

(51) Int. Cl.
*B21D 53/04* (2006.01)
*B21D 13/02* (2006.01)
*F28F 13/12* (2006.01)

(52) U.S. Cl. ..... 72/379.6; 72/385; 72/412; 165/109.1; 165/170; 165/177

(58) Field of Classification Search ..... 72/117, 72/325, 326, 389.2, 389.3, 385, 379.6, 412, 72/414; 165/109.1, 170, 177
See application file for complete search history.

(56) References Cited

U.S. PATENT DOCUMENTS

| | | | | |
|---|---|---|---|---|
| 3,768,149 | A * | 10/1973 | Swaney, Jr. | 29/527.2 |
| 3,869,778 | A * | 3/1975 | Yancey | 29/6.1 |
| 4,502,315 | A * | 3/1985 | Dubrovsky et al. | 72/385 |
| 5,107,922 | A * | 4/1992 | So | 165/109.1 |
| 5,209,289 | A * | 5/1993 | Haushalter | 165/109.1 |
| 6,502,447 | B2 | 1/2003 | Adams et al. | |
| 7,608,227 | B2 * | 10/2009 | West | 422/222 |
| 7,686,070 | B2 * | 3/2010 | Chu et al. | 165/109.1 |
| 2005/0016240 | A1 * | 1/2005 | Zurawel et al. | 72/177 |

* cited by examiner

*Primary Examiner* — David Jones
(74) *Attorney, Agent, or Firm* — Ridout & Maybee LLP

(57) ABSTRACT

Disclosed is a method of forming a heat exchanger turbulizer apparatus including a member having a longitudinal axis, a lateral width and a plurality of strips including first strips and second strips, each strip extending widthwise and being corrugated longitudinally so as to form a plurality of laterally spaced-apart sections connected to one another by bridges projecting from the sections in a common direction, the bridges of the first and second strips extending in the same direction and the corrugations of the second strips being offset laterally from the corrugations of the first strips. The method comprises: crimping longitudinally-corrugated strip material between first and second forming dies to form said apparatus, said dies being adapted such that substantially all lateral movement of strip material in crimping results from strip material being drawn laterally by material that has been displaced in a direction parallel to the direction of die movement.

10 Claims, 23 Drawing Sheets

TURBULIZERS AND METHOD FOR FORMING SAME

FIELD OF THE INVENTION

The present invention relates to fins or turbulizers, for example, for heat exchangers, and to methods for forming same.

BACKGROUND OF THE INVENTION

It is known to manufacture low pressure drop (LPD) turbulizers by stamping metal strip stock to form it with transverse corrugations having openings and offset portions formed in side walls of the corrugations. In known stamping processes, a single transverse corrugation is created by each stamp cycle. Accordingly, this process is relatively slow and expensive. Further, as there are practical limits in terms of the amount by which the material can be deformed during stamping without fracture, turbulizers produced by this method typically have a relatively low ratio of corrugation amplitude to pitch and relatively low offset distance. However, known transverse-stamping processes of this type are nonetheless widely used, as same permit the manufacture of turbulizers of high utility, flowing from the geometry of the corrugations, openings and offsets obtainable. Of note, a turbulizer can be produced by this methodology which has substantially vertical corrugation sidewalls, i.e. sidewalls orientated normally to the plane of the turbulizer. Such a turbulizer, suitably brazed inside a flat tube, can render the tube relatively resistant to deformation, even under relatively high pressures. As well, balanced turbulizers can be produced by this method, i.e. turbulizers wherein the "blades" of the turbulizer (the planar portions of the turbulizers orientated parallel to the flow) are substantially equally spaced from one another.

It is also known to form LPD turbulizers by rolling or stamping strip stock to form a longitudinally-corrugated strip of sinusoidal profile, and, as indicated schematically in FIG. 1, to pass the longitudinally-corrugated strip 2 through a stamping press 5 wherein upper 6 and lower 7 dies are brought to bear against same to transversely/laterally cut and displace the corrugations to form a material 3 having corrugations having openings and offset portions formed in sidewalls of the corrugations. This process, described in United States Patent Application Publication No. US2005/0016240, published Jan. 27, 2005, which publication is hereby incorporated by reference, is relatively fast and inexpensive, but turbulizers of sinusoidal profile are not always desired since they can be difficult to produce in balanced form and do not provide the same burst strength as turbulizers with vertical corrugation sidewalls.

SUMMARY OF THE INVENTION

Forming one aspect of the invention is a method of forming an offset strip for use as a fin or a turbulizer, the offset strip being of the type having longitudinally-extending corrugations each having side walls with openings and offset portions. The method comprises the step of: crimping a longitudinally-corrugated strip between a core die and a cavity die to form said offset strip, wherein each corrugation of said longitudinally-corrugated strip has a substantially flat surface and substantially parallel sidewalls extending substantially perpendicularly from opposite sides of the flat surface.

Forming another aspect of the invention is a method of forming apparatus for use as a turbulizer or fin for a heat exchanger, the apparatus including a member having a longitudinal axis, a lateral width and a plurality of strips including one or more first strips and one or more second strips, each strip extending widthwise of the apparatus and being corrugated longitudinally so as to form a plurality of sections laterally spaced-apart from one another and connected to one another by bridges projecting from the sections in a common direction, wherein the bridges of the first strips and the second strips extend in the same direction and the corrugations of the one or more second strips are offset laterally from the corrugations of the one or more first strips. The method comprises: crimping longitudinally-corrugated strip material between first and second forming dies to form said apparatus, said dies being adapted such that substantially all lateral movement of strip material in the crimping step occurs as a result of strip material being drawn laterally by material that has been displaced in a direction parallel to the direction of relative die movement.

Forming yet another aspect of the invention is a method of forming apparatus for use as a turbulizer or fin for a heat exchanger, the apparatus including a member having a longitudinal axis, a lateral width and a plurality of strips including one or more first strips and one or more second strips, each strip extending widthwise of the apparatus and being corrugated longitudinally so as to form a plurality of sections laterally spaced-apart from one another and connected to one another by bridges projecting from the sections in a common direction with respect to each strip, wherein each of the one or more first strips and each of the one or more second strips has a profile which differs from that of the longitudinally-corrugated strip, wherein the bridges of the first strips and the second strips extend in the same direction and the corrugations of the one or more second strips are offset laterally from the corrugations of the one or more first strips. The method comprises: crimping a longitudinally-corrugated strip between a core die and a cavity die to form said turbulizer, wherein each corrugation of said longitudinally-corrugated strip has a flat surface and parallel sidewalls extending substantially perpendicularly from opposite sides of the flat surface; and wherein each bridge of the first strip and second strip is formed by a flat surface of the core die which impinges upon and in coplanar relation with the flat surface of a respective corrugation as crimping commences.

Forming another aspect of the invention is a method of forming, from a longitudinally-corrugated strip, apparatus for use as a turbulizer or fin for a heat exchanger, the apparatus including a member having a longitudinal axis, a lateral width and a plurality of strips including one or more first strips, one or more second strips and one or more third strips, each strip extending widthwise of the apparatus and being corrugated longitudinally so as to form a plurality of sections laterally spaced-apart from one another and connected to one another by bridges projecting from the sections in a common direction with respect to each strip, wherein each of the one or more first strips and the one or more second strips has a profile which differs from that of the longitudinally-corrugated strip, wherein the bridges of the first strips and the second strips extend in the same direction and the corrugations of the one or more second strips are offset laterally from the corrugations of the one or more first strips. The method comprises: a forming step, wherein first and second forming dies move between an open position and a closed position to engage the corrugated strip between them to form said turbulizer, characterized in that substantially all lateral movement of longitudinally-corrugated strip material in the forming step occurs as a result of said strip material being drawn laterally by a laterally-connected portion of said strip material that has been displaced in a direction parallel to the direction of relative die movement.

Apparatus formed according to the methods form further aspects of the invention.

The methods permit the relatively inexpensive construction of the apparatus. The structures can have substantially vertical bridge sidewalls, can have offset corrugations having a relatively high ratio of corrugation amplitude to pitch, can produce a relatively low pressure drop in use and can have relatively large offsets.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter being briefly described hereinafter.

BRIEF DESCRIPTION OF THE DRAWINGS

The present invention will now be more fully described, by way of example only, with reference to the accompanying drawings. In the accompanying drawings.

DETAILED DESCRIPTION

Figure 4:
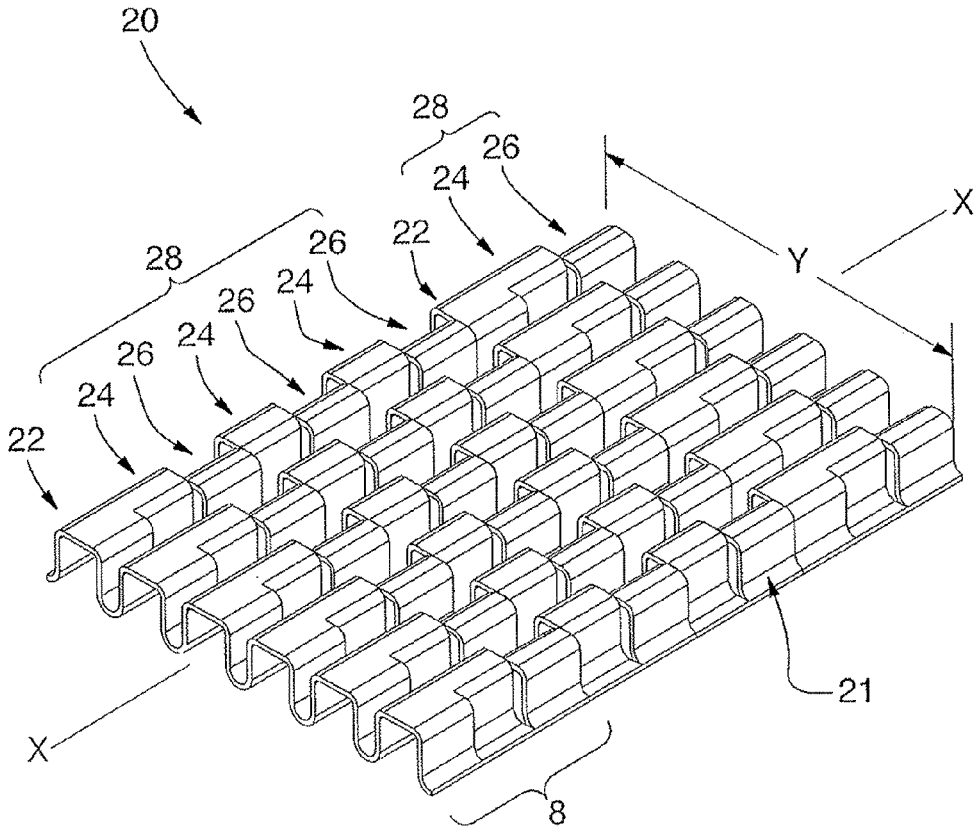
FIG. 4 is a perspective view of an exemplary turbulizer according to one aspect of the invention.

A turbulizer or fin apparatus 20 for a heat exchanger forms one aspect of the invention and is hereinafter described with reference to FIG. 4, wherein an exemplary turbulizer 20 according to the invention is shown, and with reference to FIGS. 8, 18-21 and 28, wherein a structure which corresponds to bracketed portion 8 of FIG. 4 is shown.

The turbulizer structure 20 will be seen to comprise a member, designated with general reference numeral 21, having a longitudinal axis X-X, a lateral width Y and a plurality of strips 22,24,26. Member 21 takes the form of a 0.010" inch aluminum sheet material. The plurality of strips 22,24,26 includes first strips 24, second strips 26 and third strips 22. The first strips 24 and the second strips 26 are arranged in groupings 28, wherein they are arranged in longitudinally-alternating relation to one another. The third strips 22 are separated from one another by the groupings 28.

Figure 8:
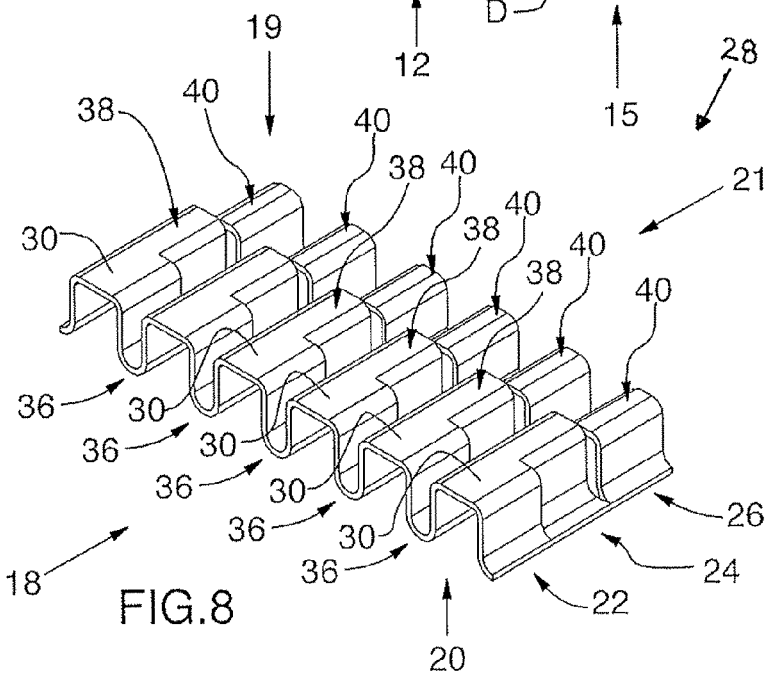
FIG. 8 is an enlarged view of encircled area 8 of FIG. 6 which corresponds to bracketed portion 8 of FIG. 4.
Figure 9:
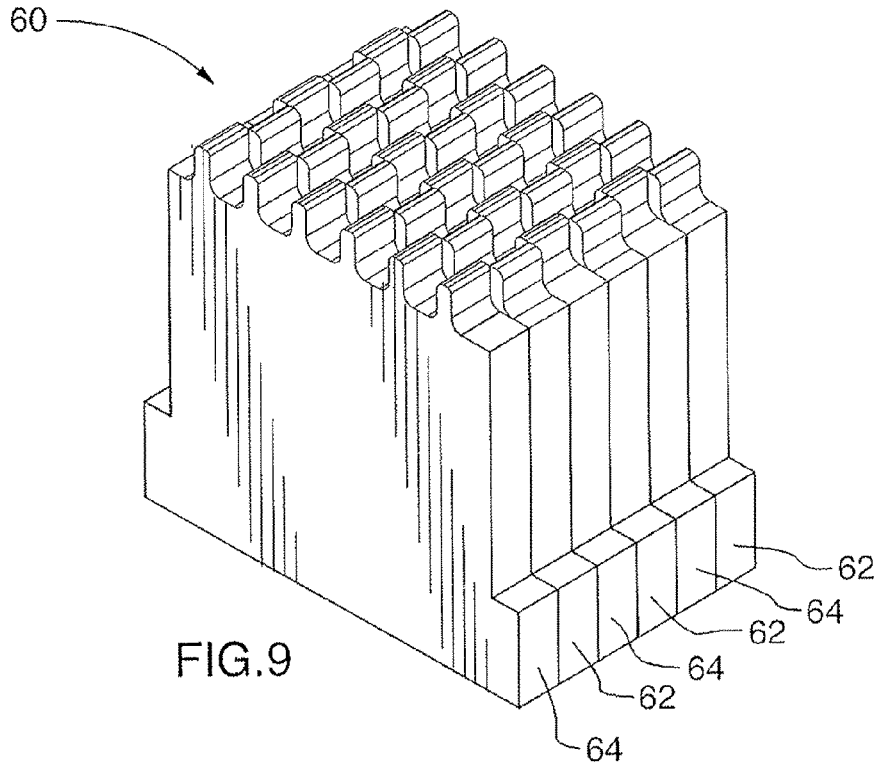
FIG. 9 is an enlarged view of encircled area 9 of FIG. 6.
Figure 10:
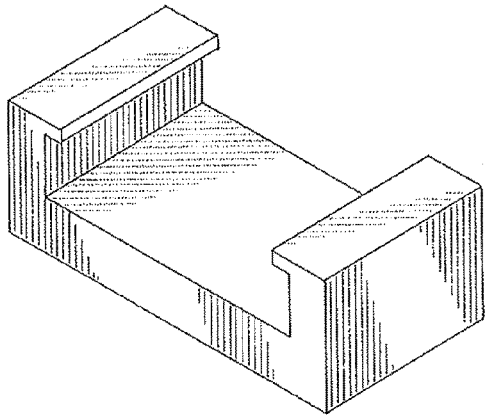
FIG. 10 is an enlarged view of encircled area 10 of FIG. 6.
Figure 11:
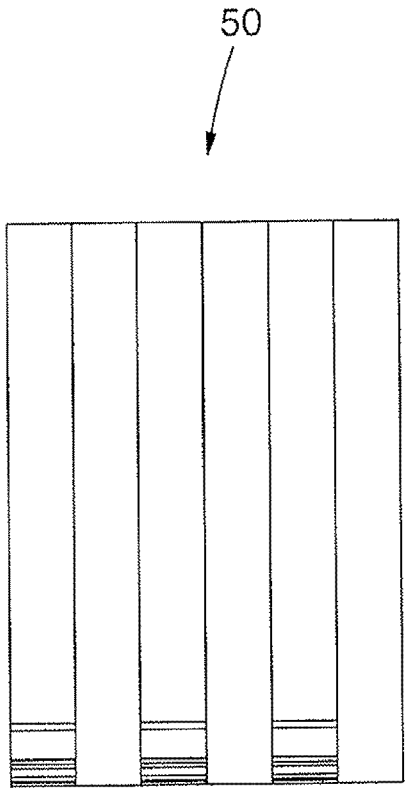
FIG. 11 is a view along arrow 11 of FIG. 7.
Figure 13:
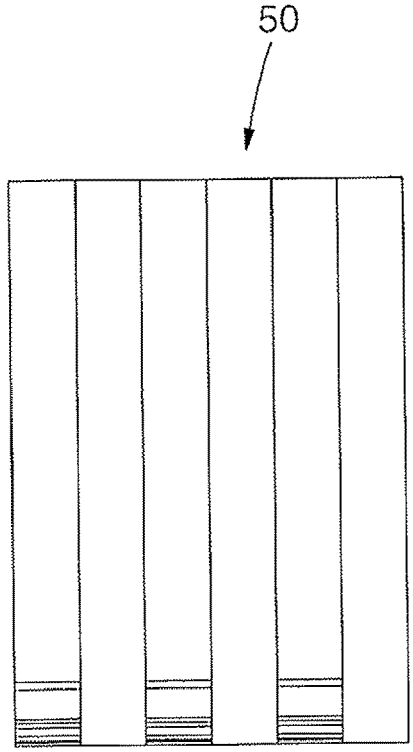
FIG. 13 is a view along arrow 13 of FIG. 7.
Figure 12:
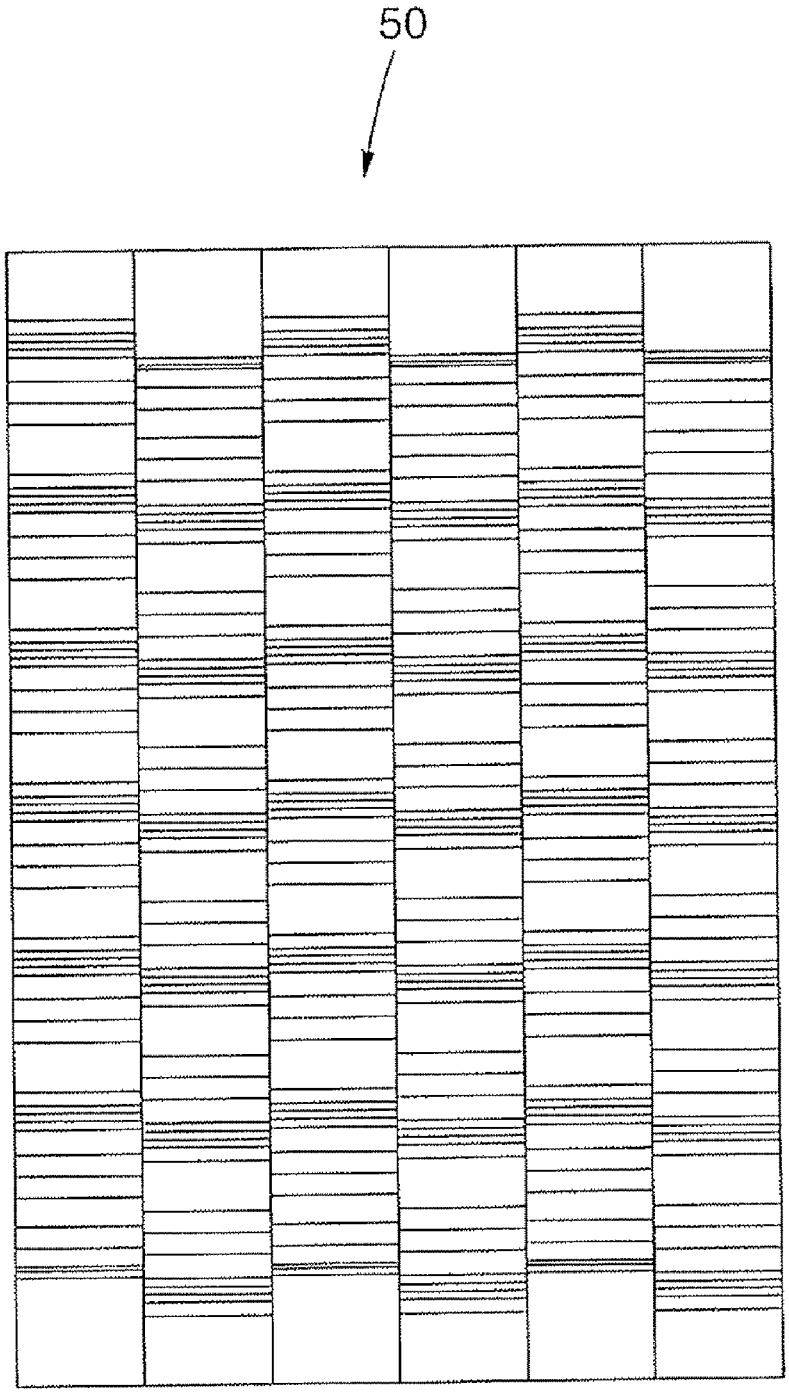
FIG. 12 is a view along arrow 12 of FIG. 7.
Figure 14:
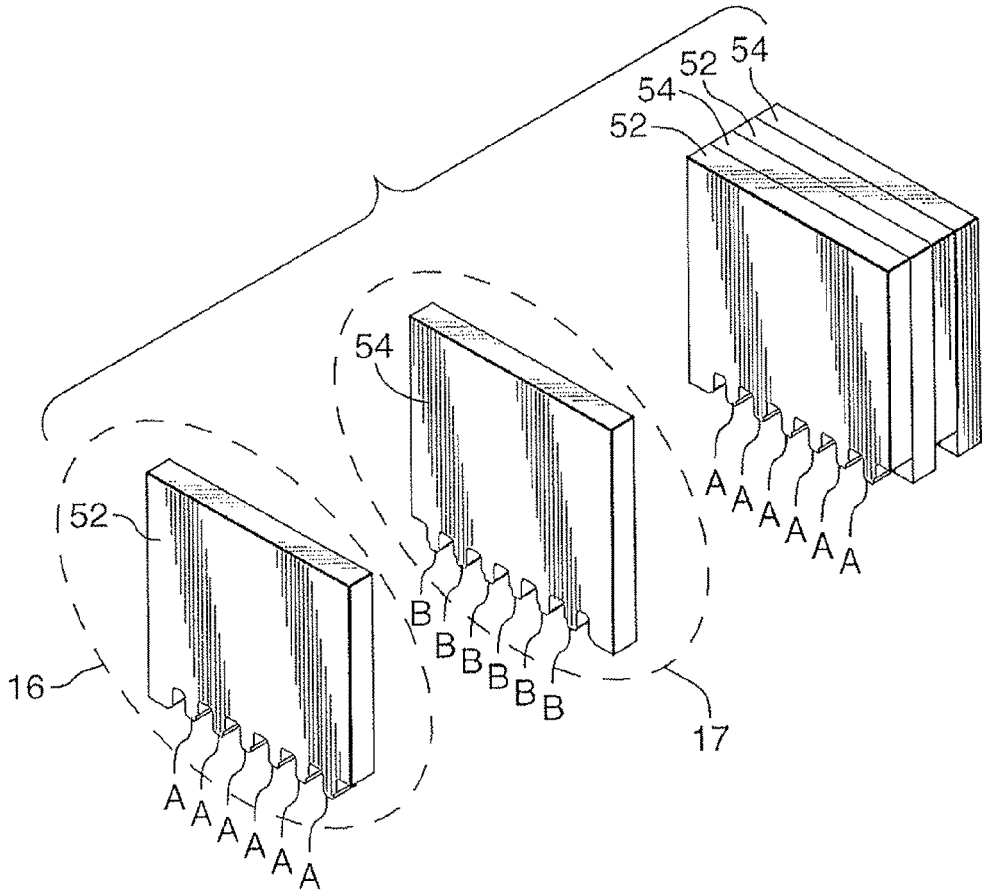
FIG. 14 is a partially exploded view of the structure of FIG. 7
Figure 15:
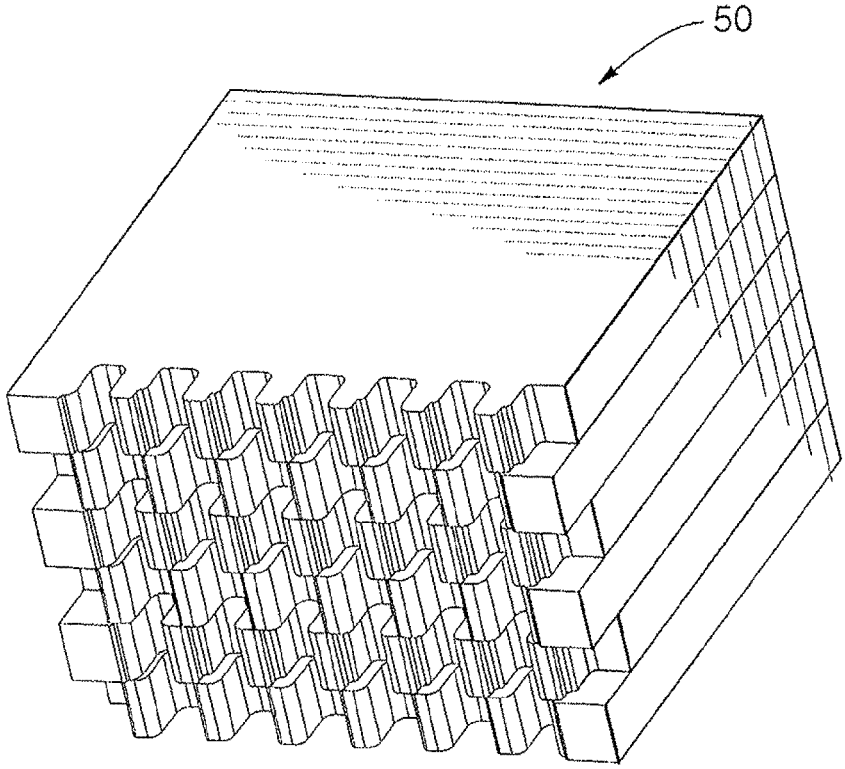
FIG. 15 is a view along arrow 15 of FIG. 7.
Figure 16:
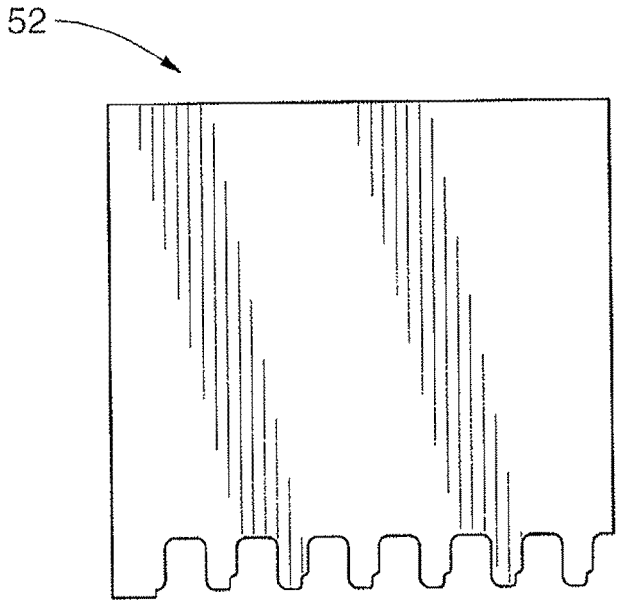
FIG. 16 is an enlarged view of encircled area 16 of FIG. 14.
Figure 17:
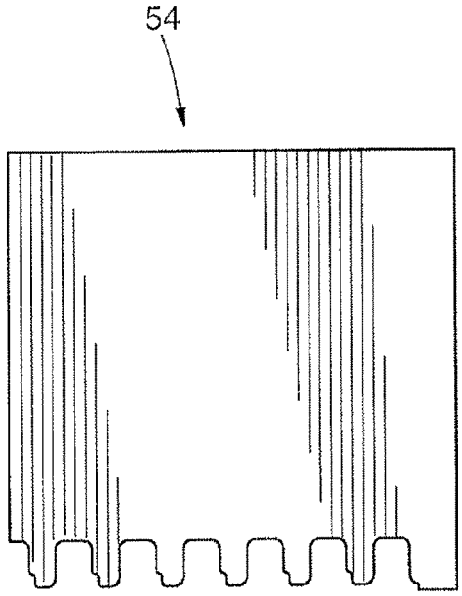
FIG. 17 is an enlarged view of encircled area 17 of FIG. 14.
Figure 18:
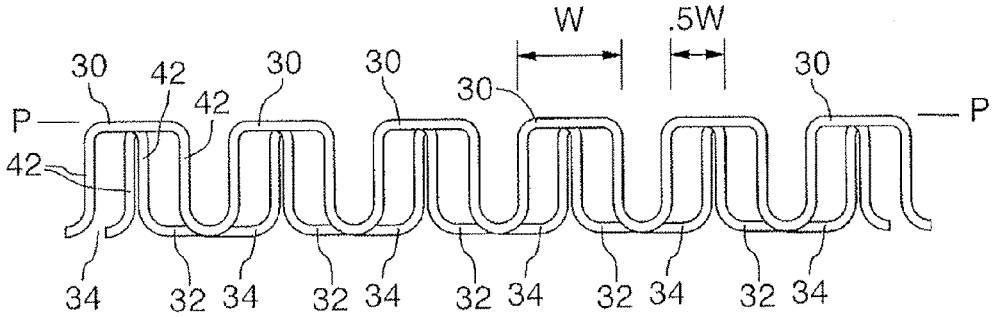
FIG. 18 is a view along arrow 18 of FIG. 8.
Figure 19:
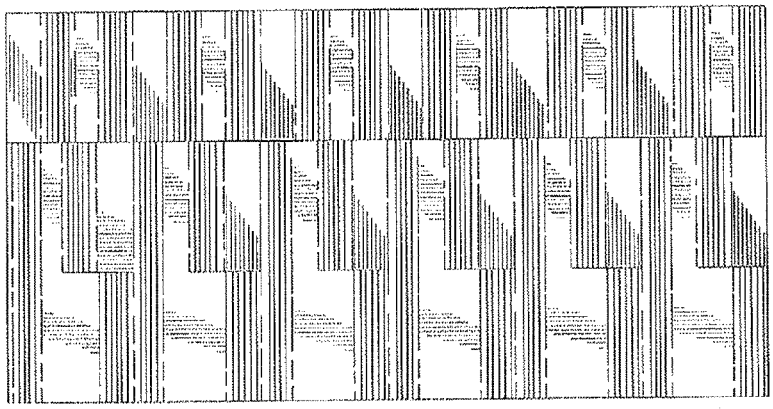
FIG. 19 is a view along arrow 19 of FIG. 8.
Figure 20:
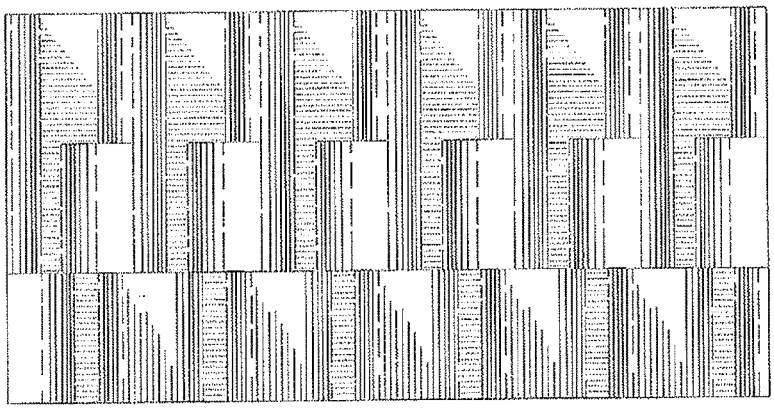
FIG. 20 is a view along arrow 20 of FIG. 8.
Figure 21:
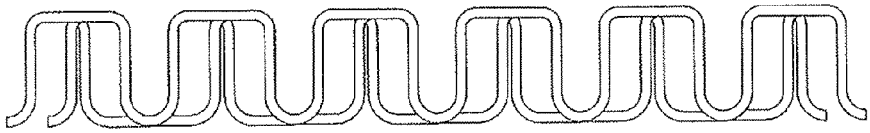
FIG. 21 is a view along arrow 21 of FIG. 8.
Figure 22:
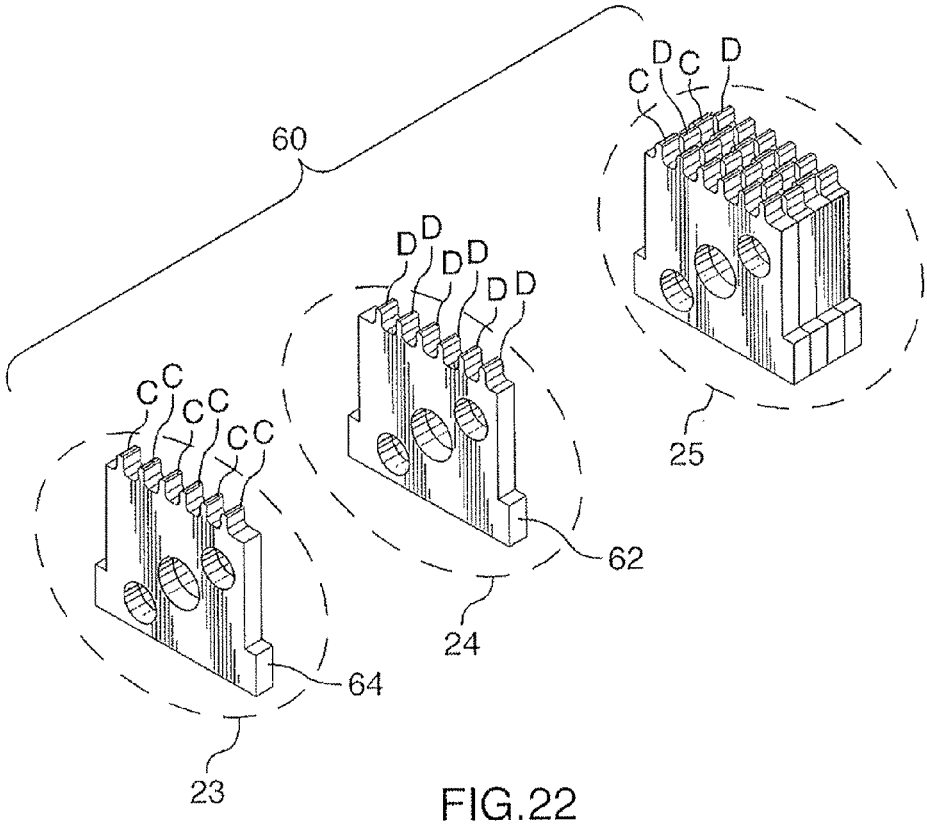
FIG. 22 is a partially exploded view of the structure of FIG. 9.
Figure 23:
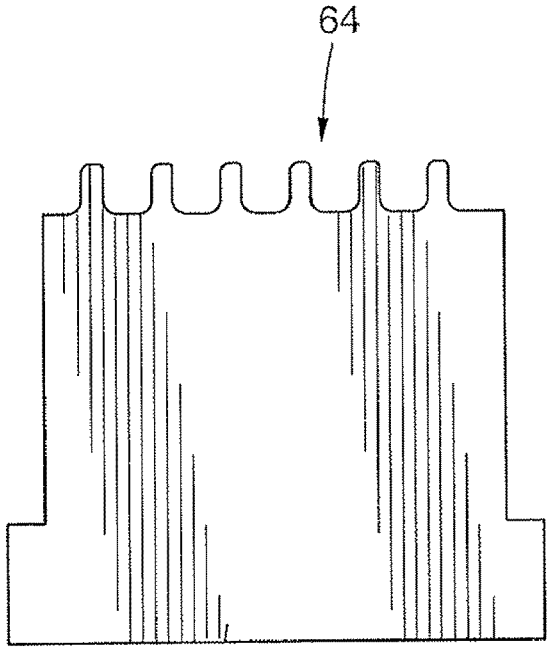
FIG. 23 is an enlarged, side elevational view of encircled area 23 of FIG. 22.
Figure 24:
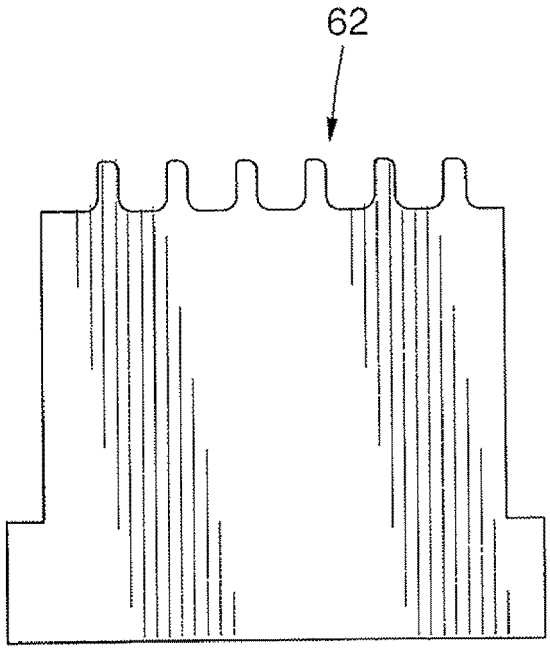
FIG. 24 is an enlarged, side elevational view of encircled area 24 of FIG. 22.
Figure 25:
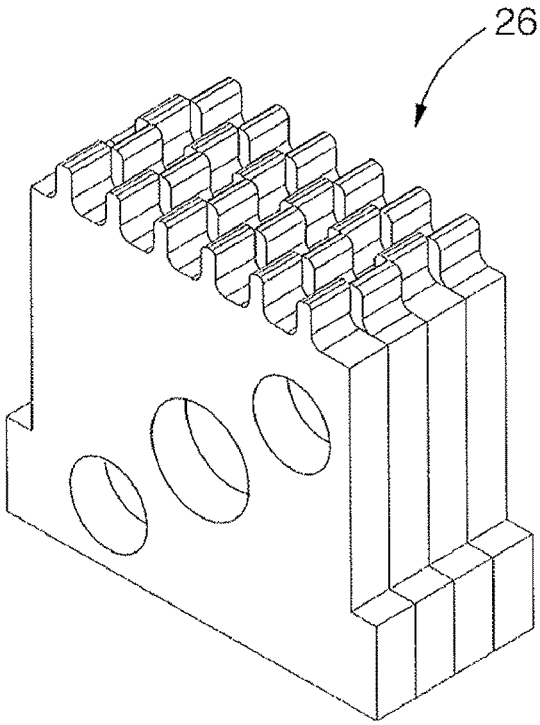
FIG. 25 is an enlarged view of encircled area 25 of FIG. 22.
Figure 26:
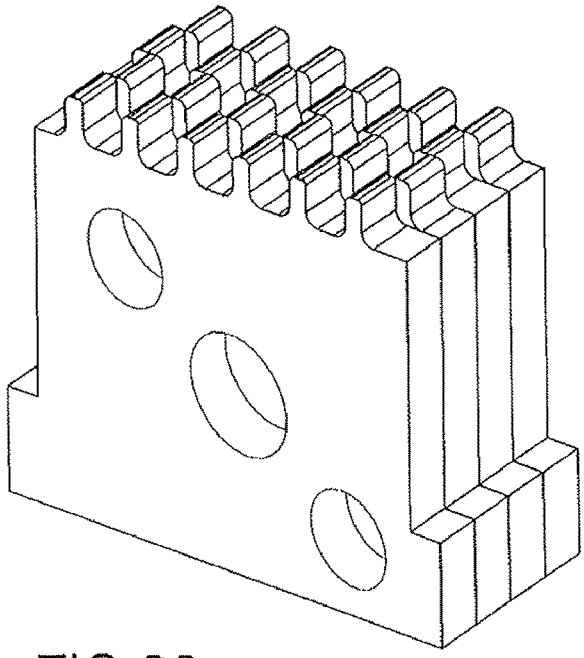
FIG. 26 is a view along arrow 26 of FIG. 25.

With reference to FIGS. 4, 8 and 18, each strip 22,24,26 extends widthwise of the member 21 and is corrugated longitudinally so as to form a plurality of substantially coplanar, flat sections 30,32,34 laterally spaced-apart from one another, and a plurality of U-shaped bridges 36,38,40 projecting from the flat sections in a common direction (in the context of each strip), each bridge 36,38,40 connecting a respective pair of the flat sections 30,32,34 and having a profile that remains substantially constant along its length. The flat sections 32,34 of the first strips 24 and the second strips 26 are coplanar. The flat sections 30 of the third strips 22 lie in a plane P-P to which the bridges 38,40 of the first strips 24 and the second strips 26 extend. The bridges 38,40 of the first strips 24 and the second strips 26 extend in the same direction. The bridges 36 of the third strips 22 extend in an opposite direction to that in which the bridges 38,40 of the first strips 24 and the second strips 26 extend. The bridges 38,40,36 of the first 24, second 26 and third 22 strips have sidewall portions 42 that are substantially parallel to one another and perpendicular to the plane P-P of the turbulizer. The corrugations of said second strips 26 are offset laterally from the corrugations of said first strips 24.

The exemplary turbulizer structure 20 could be used, for example, in a stacked-plate type radiator, in a low-pressure-drop orientation wherein the longitudinal axis of the turbulizer was orientated parallel with the fluid flow. Suitably brazed inside a flat tube, this turbulizer 20 would render the tube relatively resistant to deformation, even under relatively high internal pressures, and would provide turbulence to the flow, which can be of assistance in heat transfer.

Construction of such turbulizers can be via a method of the general type, as described, for example, in United States Patent Application Publication No. US 2005/0016240, wherein in a forming step first and second forming dies move between an open position and a closed position to engage the corrugated strip between them and form a portion of said turbulizer by cutting and displacing portions thereof.

Figure 1:
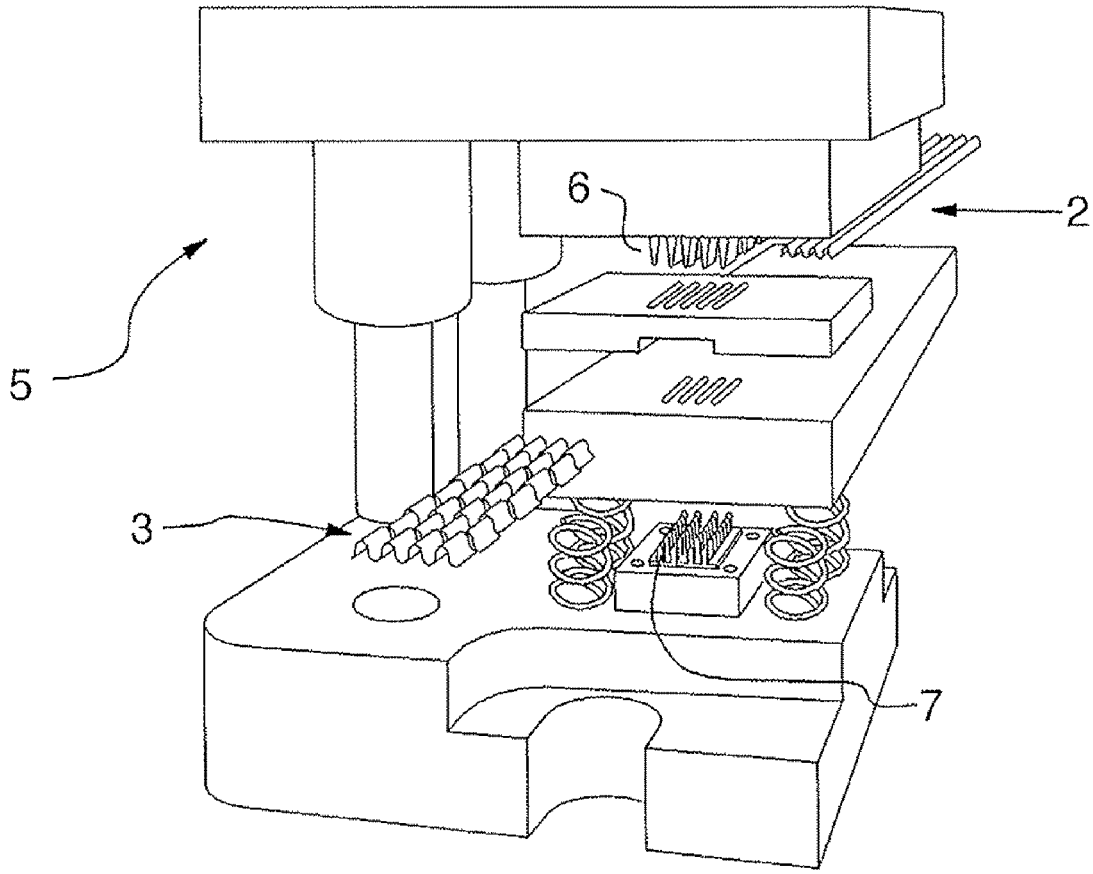
FIG.1 PRIOR ART
FIG. 1 is a partially schematic view of a prior art apparatus for forming prior art turbulizers in use.
Figure 2:
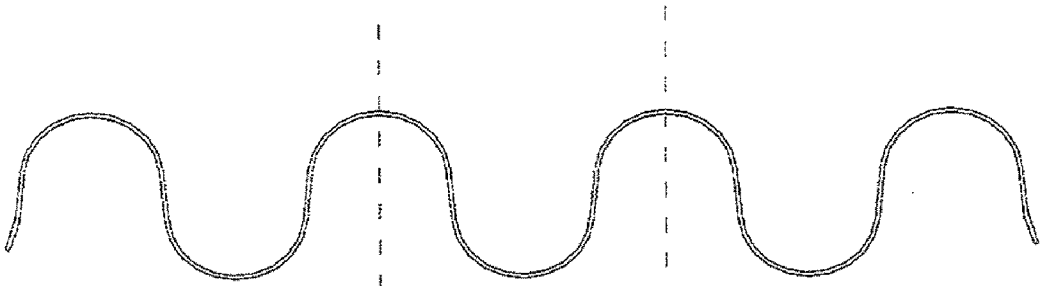
FIG.2 (PRIOR ART)
FIG. 2 is a profile view of the structure indicated by arrow 2 in FIG. 1.
Figure 3:
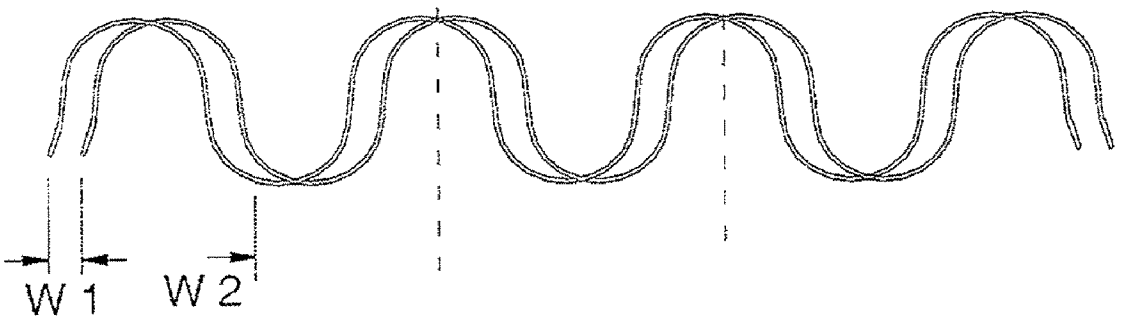
FIG.3(PRIOR ART)
FIG. 3 is a profile view of the structure indicated by arrow 3 in FIG. 1.

However, whereas in US 2005/0016240 substantially all of the corrugations in the strip are laterally or transversely offset during the forming step, as indicated by the sequence of FIGS. 2, 3, in the present method, portions of the bridges 38,40 are defined by portions of the longitudinally-corrugated strip 2 which are not displaced during said forming step. (Bridges 36 are defined entirely by portions of the longitudinally-corrugated strip 2 which are not displaced during the forming step.)

Figure 5:
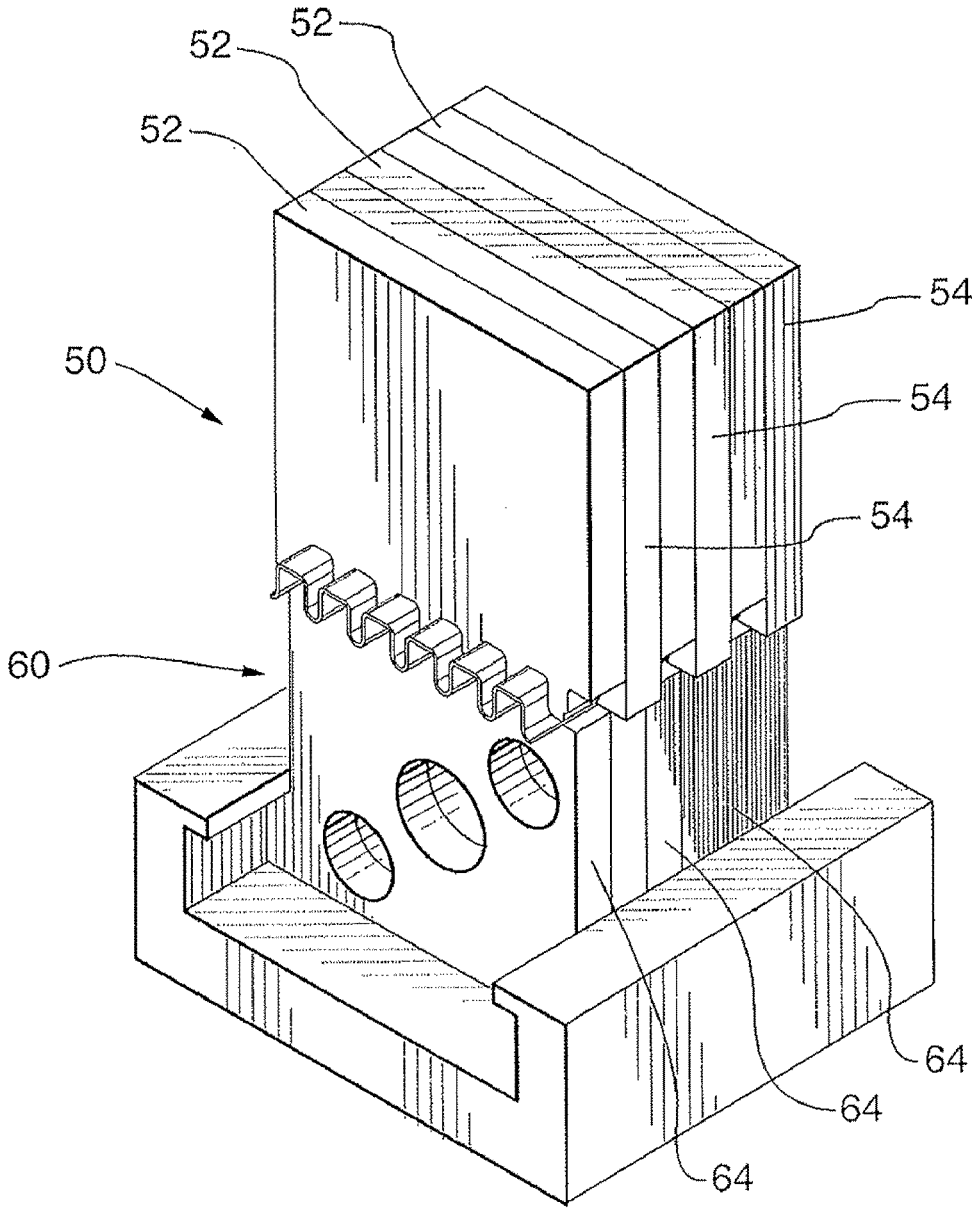
FIG. 5 is a partially schematic perspective view of one form of apparatus for use in the method of the invention.
Figure 6:
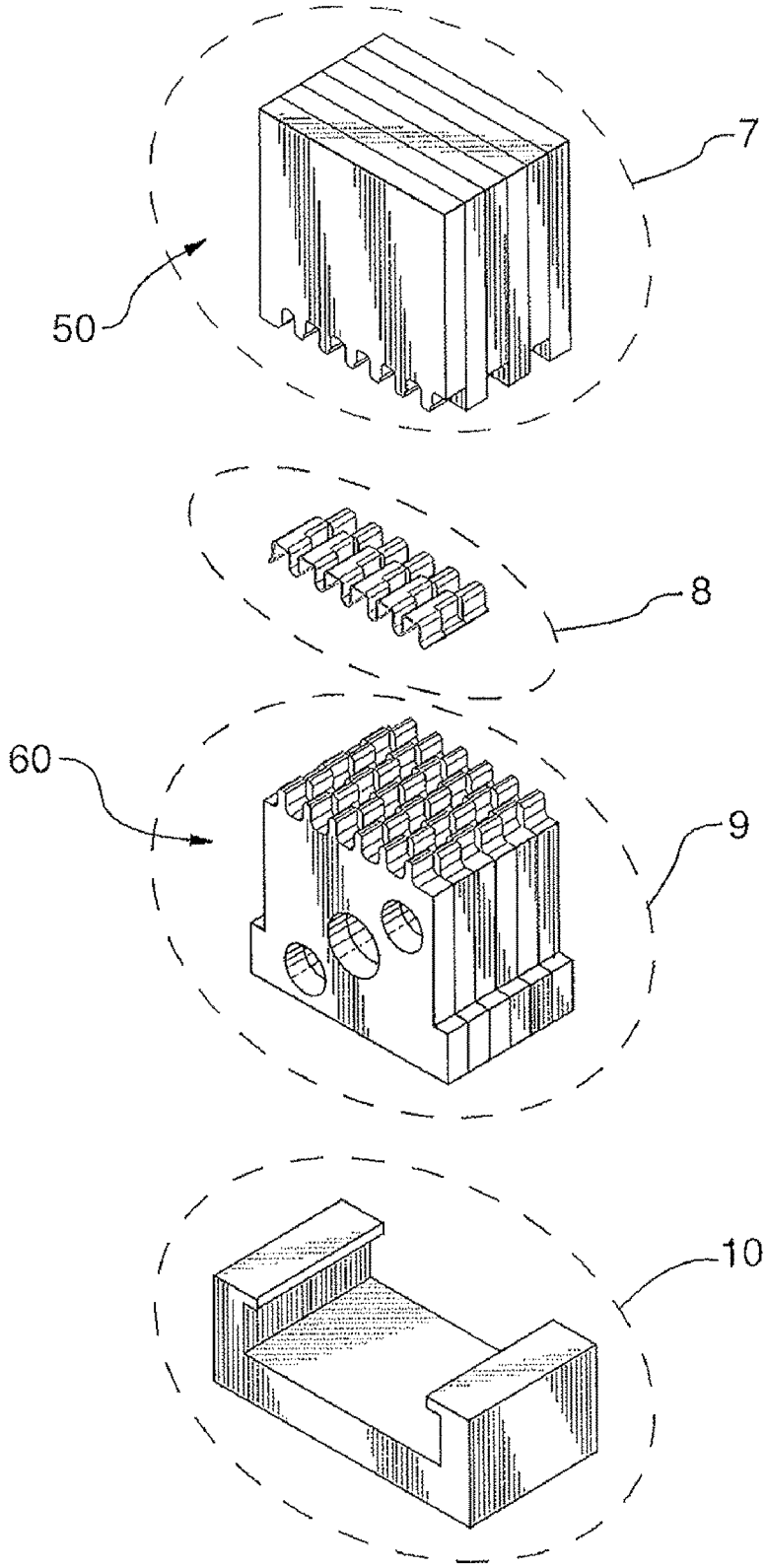
FIG. 6 is an exploded view of the apparatus of FIG. 5.
Figure 7:
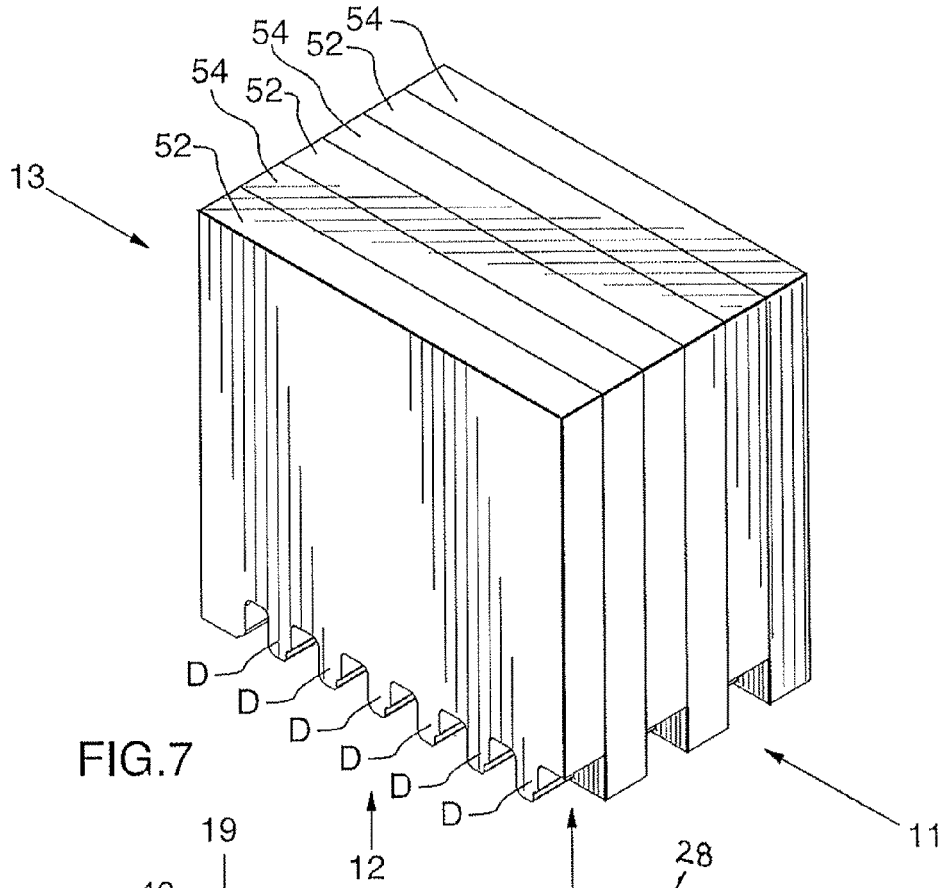
FIG. 7 is an enlarged view of encircled area 7 of FIG. 6.

An exemplary die set is shown in FIGS. 5-7, 9, 11-17 and 22-26, and will be seen to comprise an upper, first core die 50 and a lower, second cavity die 60. Each of the upper 50 and lower 60 dies is formed of a plurality of die portions 52,54, 62,64 with complementary profiles. As shown, the upper die 50 includes six upper die portions 52,54 of two types 52 and 54 disposed in longitudinally alternating relation, and the lower die includes six lower die portions 62,64, also of two types 62 and 64 disposed in longitudinally alternating relation. The die portions 52,54,62,64 each have six teeth A,B, D,C extending therefrom. In FIG. 5, the lower die block 60 is gripped in a fixture 95, but it should be understood that the manner in which the dies are mounted in the press forms no part of the invention, and the mounting of dies in a press is a matter of routine to persons of ordinary skill in the art.

Figure 27A:
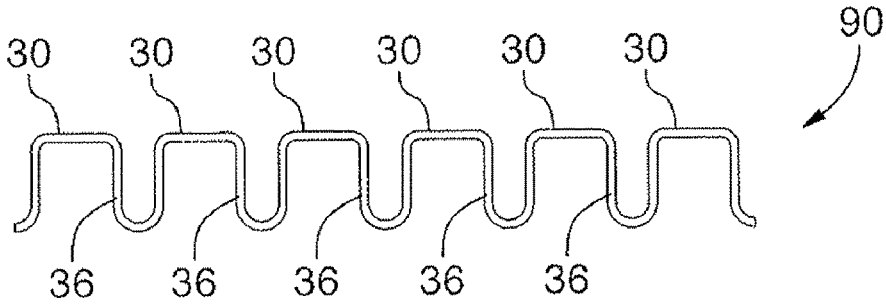
FIG. 27A is a view similar to FIG. 2 of an exemplary longitudinally-corrugated strip for use with the method of the invention.
Figure 27B:
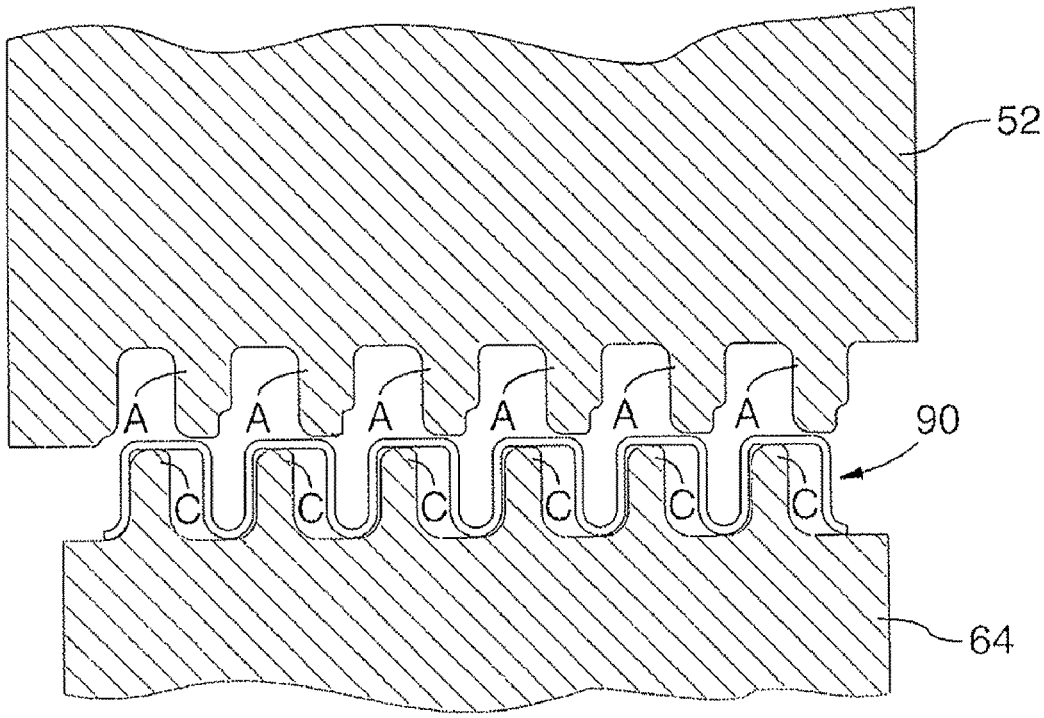
FIG. 27B-D is a series of cross-section views showing portions of the structure of FIG. 5 in use with the strip of 27A.
Figure 27C:
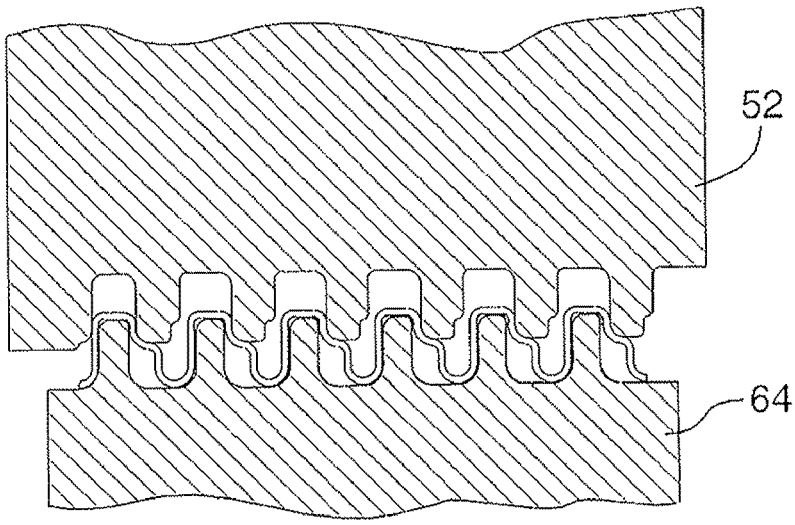
Figure 27D:
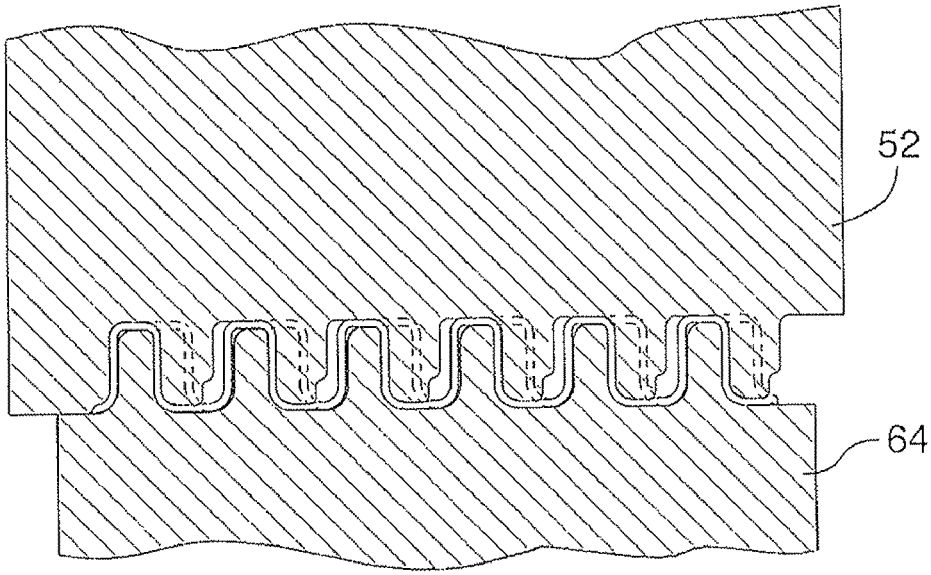
Figure 27E:
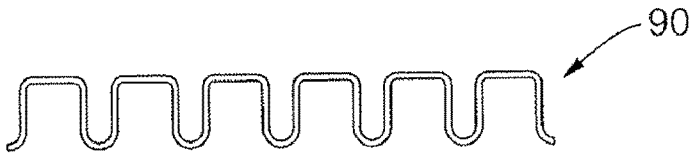
FIG. 27E is a view similar to FIG. 27A.
Figure 27F:
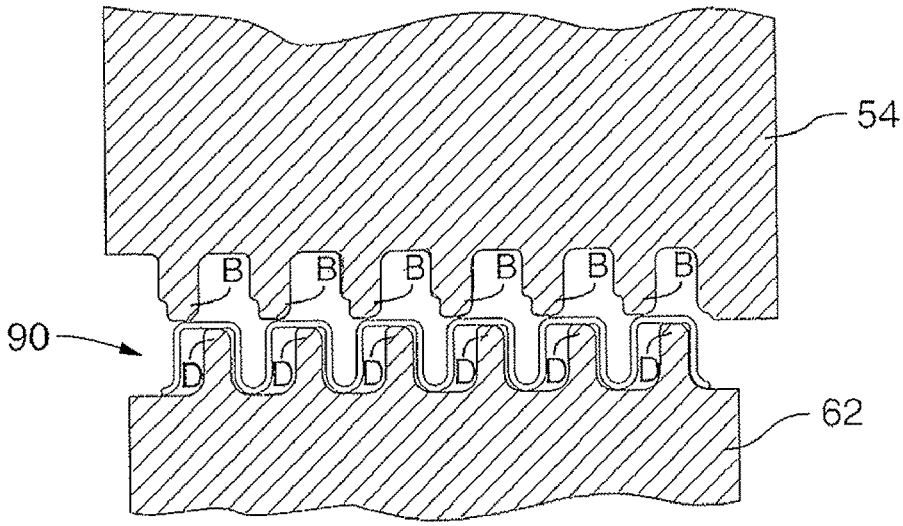
FIG. 27F-G is a series of cross-section views showing portions of the structure of FIG. 5 in use with the strip of 27E.
Figure 27G:
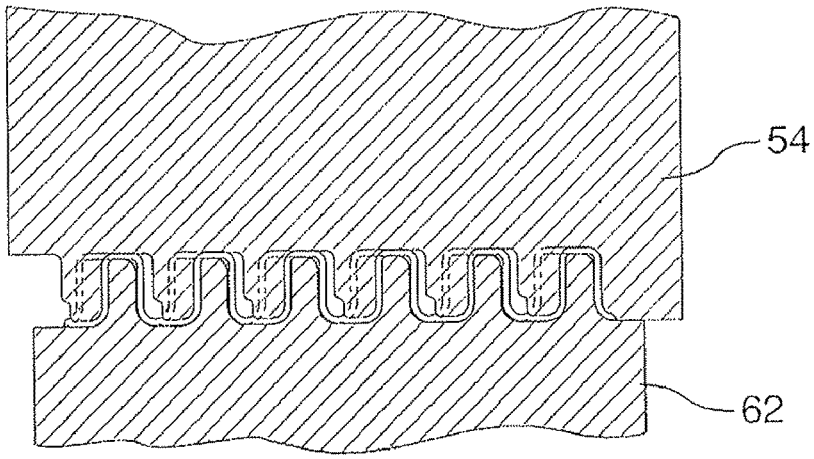
Figure 28:
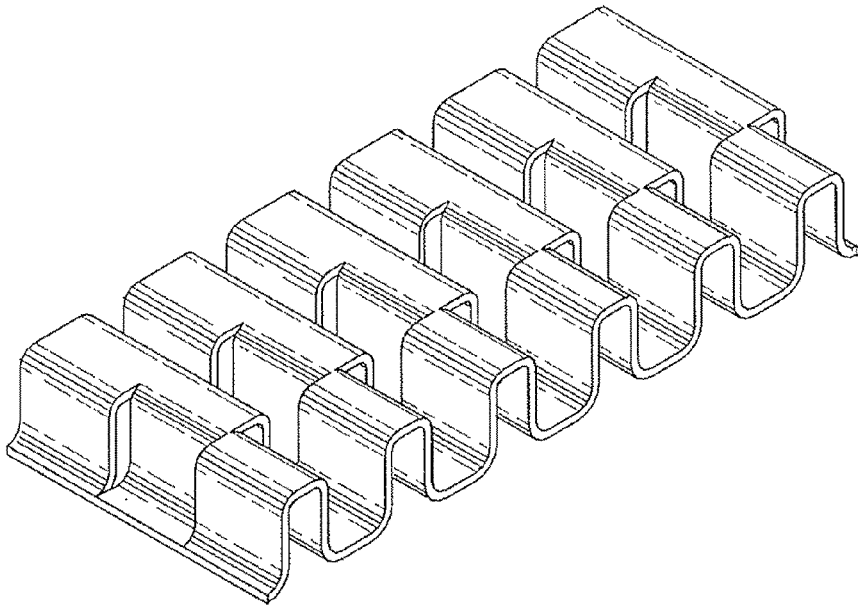
FIG. 28 is a view along arrow 28 of FIG. 8.

The manner in which the offsets are provided in the present invention via the exemplary die set is shown in the sequence of FIGS. 27B-D and 27F-G. FIGS. 27B-D represent a view of a respective pair of die portions 52,64 as the upper die 50 and lower die 60 are brought together about a corrugated strip 90 having a profile identical to that of strip 22 in the turbulizer 20 of FIG. 4, which is characterized by longitudinally-extending corrugations, each corrugation having a flat surface lying in the plane of flat sections 30 and parallel sidewalls extending substantially perpendicularly from opposite sides of the flat surface. During such action, each tooth A bears directly down on top of a respective corrugation, to simultaneously cut and displace a portion of same. As crimping commences, a flat end surface A' of each tooth A impinges upon and in coplanar relation with a flat surface 30 of a respective corrugation. Teeth A have rounded end edges, so as to avoid the creation of longitudinally-extending cuts. Each tooth A causes the portion upon which it impinges to be cut and displaced against a lower tooth C during this process, and the length of the portion which is cut and displaced remains constant, such that the strip material is not "thinned" and maintains its strength. Importantly, although the ultimate effect of the operation is a "lateral" translation, it should be appreciated that the direct action between the teeth and the strip material is perpendicular to both the longitudinal and lateral axes, i.e. vertical in the context of FIGS. 27B-G, and lateral movement of material occurs primarily as a result of the strip material being drawn to one lateral side by a laterally-connected portion of the strip material that has been vertically displaced, i.e. displaced in a direction parallel to the direction of relative die movement and normal to the plane of the turbulizer. Conceptually, the material can be viewed as being simultaneously "torn" and displaced. FIGS. 27F-G represent a view of a respective pair of die portions 54,62 as the upper the 50 and lower die 60 are brought together about a corrugated strip 90 having a profile identical to that of strip 22 in the turbulizer 20 of FIG. 4. During such action, each tooth B bears directly down on top of a respective corrugation, to simultaneously cut and displace a portion of same in a manner analogous to that described above. That is, teeth B have rounded end edges, so as to avoid the creation of longitudinally-extending cuts, a flat surface B' of each tooth B impinges in coplanar relation upon a flat surface of a respective corrugation at the commencement of crimping, and each tooth B causes the portion upon which it impinges to be simultaneously "torn" and "displaced" against a lower tooth D, so as to cause lateral translation of material without thinning.

This methodology produces turbulizer/fin structures which can exhibit relatively low pressure drop in the LPD orientation in comparison to known LPD turbulizers. Without intending to be bound by theory, it is believed that this flows from the fact that much of the "burr" material resultant from shearing lies in the plane of the sidewalls of the corrugations, since the sidewalls of the corrugations are orientated parallel to the direction of relative die movement. Dies used in the method have also been observed to wear at a relatively low rate, which tends to reduce burring. Without intending to be bound by theory, such low wear rate is believed to flow at least in part from the fact that the dies used in this method do not deform all of the sheet material to produce the corrugations, but leave portions untouched. A yet further advantage associated with the methodology is an improved ability to produce turbulizers wherein the ratio of corrugation amplitude to pitch is relatively high, which flows from the relatively more robust structure associated with the die elements employed in the subject method. By way of explanation, in known methods, such as described in United States Patent Application Publication No. US2005/0016240, the dimensions of the die elements are constrained by the "width" of the offset corrugations. This is because all of the corrugations are fully occupied by the dies at the midpoint of each stamping cycle, since substantially all of the material is displaced, in one direction or another, during the stamping step. This is in contrast to the methodology of the present invention wherein portions of the strip material are not displaced, i.e. in the construction of the first strips and the second strips, only one side of each corrugation in the precursor longitudinally corrugated strip is displaced. Thus, the dimensions of the die elements employed are not constrained by the corrugation size, but rather, as a function of the spacing between corrugations in the precursor strip and the offsets, which permits the die elements to be relatively robust.

Persons of ordinary skill in the art will readily recognize that this exemplary die set 50,60 could be used in the method to produce the turbulizer shown in FIG. 4. To do so, corrugated material having a profile identical to that of strips 22 in FIG. 4 would be stamped at least twice by the die set 50,60, the corrugated material being moved longitudinally between stampings. Each stamping cycle would produce a grouping 28 of longitudinally alternating first 24 and second 26 strips, with each first strip 24 being defined by and between a respective pair of die portions 52,64 and each second strip 26 being defined by and between a respective pair of die portions 54 and 62.

The distance by which the corrugated material was longitudinally displaced between stamp cycles defines the longitudinal length of the third strip 22 separating the groupings 28 from one another. The then-stamped material could then be cut to length as necessary in a conventional manner, to form the structure of FIG. 4. Alternatively, a segment of corrugated material 90 equal in length to the turbulizer 20 of FIG. 4 could be fed into the die set to the same result.

Whereas but a single turbulizer or fin 20 has been thus far described, along with an exemplary die set for the production of same, it will be appreciated that with routine modification, turbulizers and fins of great variety can be produced.

For example, turbulizers and fins of greatly varied length can be produced.

As well, whereas in the turbulizer shown, six (6) corrugations are provided, greater or lesser numbers of corrugations could be provided (in which case the number of the teeth on each die portion would normally be varied accordingly).

Figure 29:
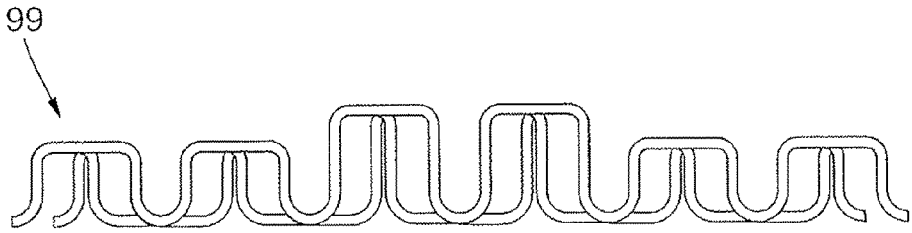
FIG. 29 is a view similar to FIG. 18 of a further exemplary turbulizer.

Further, whereas in the turbulizers shown and described thus far, all of the corrugations have a similar "height", the invention can be employed in the context of variable height turbulizers or fins 99, as indicated in FIG. 29, for use in applications wherein the height of the flow channel varies along the width of the flow channel.

Of course, whereas aluminum sheet material 0.010" in thickness has been previously specified, it will be understood that other materials of other thicknesses could be utilized. For turbulizers, 0.010-0.012" thickness aluminum is regularly utilized and for fins, aluminum material of about 0.005" in thickness is regularly used, but variations can be routinely accommodated and are contemplated.

Figure 30A:
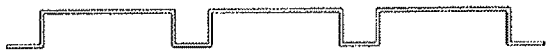
FIG. 30A is a view similar to FIG. 2 of a further exemplary longitudinally-corrugated strip for use with the method of the invention.
Figure 30B:
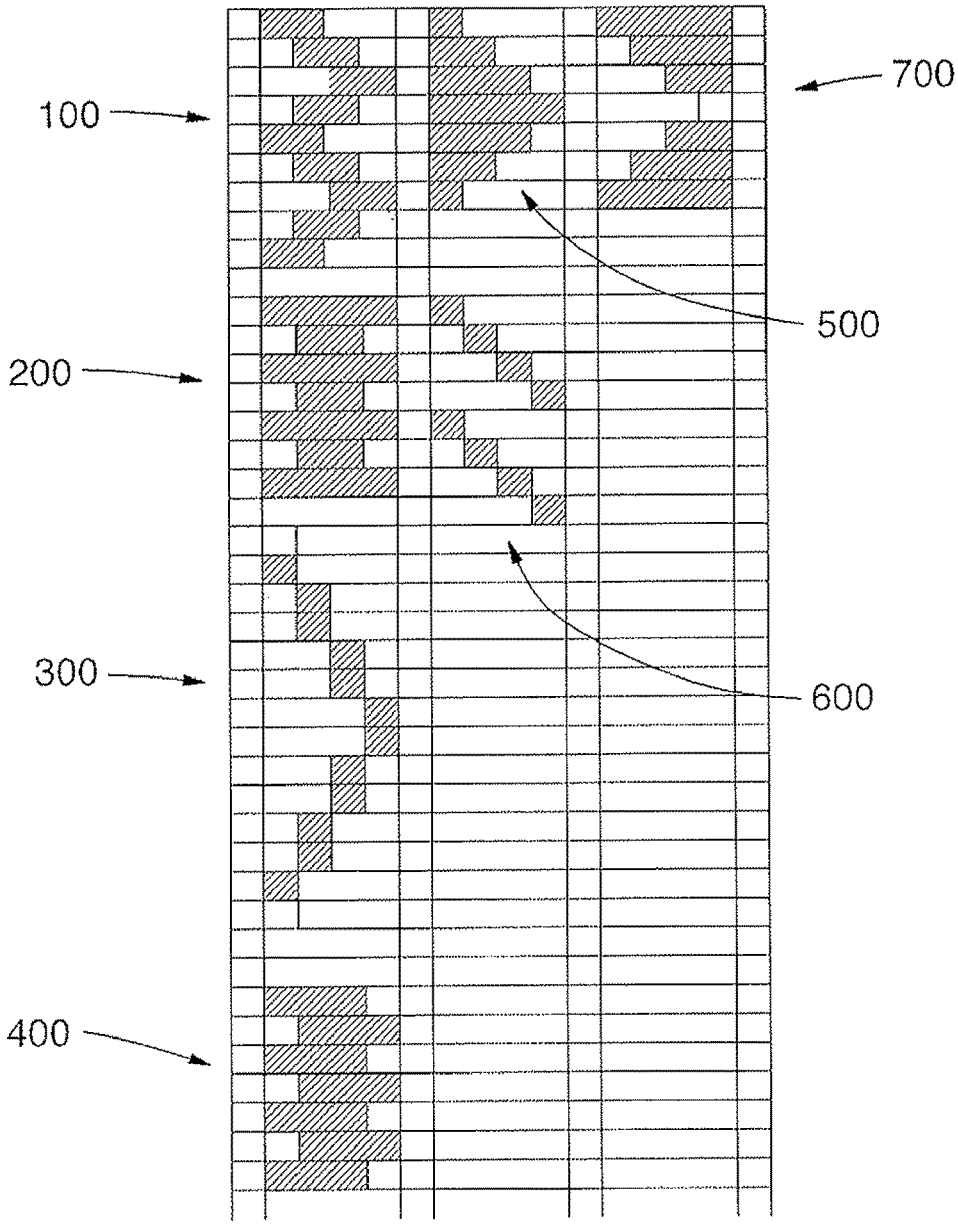
FIG. 30B is a top plan partially schematic view of a yet further exemplary turbulizer made according to embodiments of the method of the invention from the strip of FIG. 30A.
Figure 31:
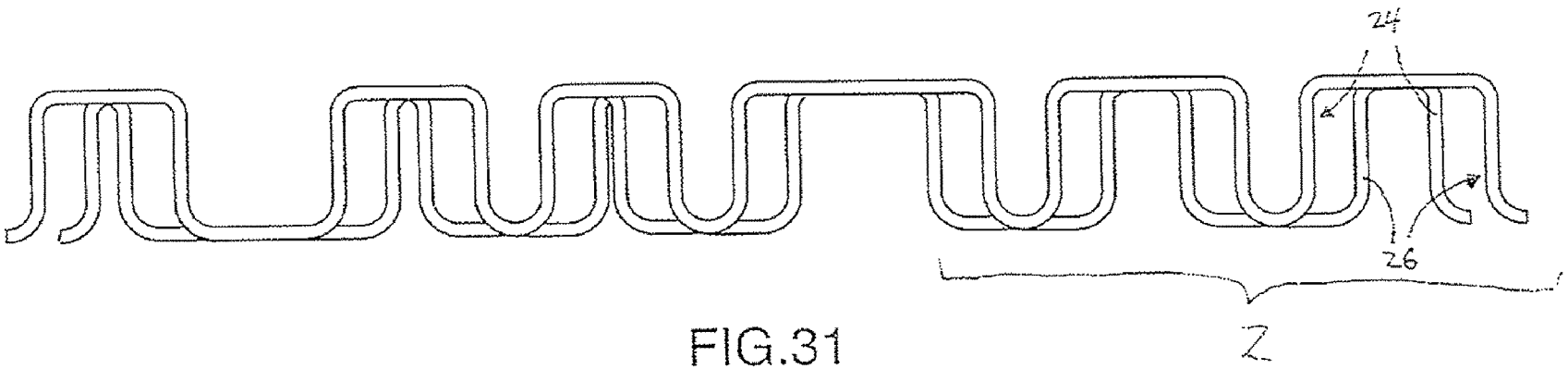
FIG. 31 is a view similar to FIG. 18 of a further exemplary turbulizer.

Additionally, whereas in the turbulizer shown in FIG. 4, the corrugations in the third strips are substantially identical to one another, and the corrugations in the first strips and second strips are all substantially identical to one another, it will be appreciated that variations can routinely be made, merely by altering the profile of the corrugated material feedstock and/or modifying the dies, so as to alter the density of fins (bridge sidewalls) in the flow path, the degree of fin offset to one another and fin placement. The great flexibility that can be afforded through the method of the invention is indicated by FIGS. 30A and 30B, which show corrugation patterns that can be readily achieved in this manner to tailor the flow characteristics of the heat exchanger in which they are employed. For greater clarity, FIG. 30A is a profile view of a longitudinally corrugated strip prior to any forming step (i.e. feedstock), and FIG. 30B shows schematically a number of corrugation patterns, 100-700, that each can be created by suitable pairs of modified die blocks. In FIG. 30B, hatched portions indicate areas of the original raised portions of the profile whose position remains unchanged following the forming step, and white portions show portions that are coplanar with the base of the original profile (i.e. the flat sections of the third strip) following the forming step. A profile of a yet further turbulizer is shown in FIG. 31, wherein the pitch of the corrugations varies but the turbulizer is otherwise similar to that of FIG. 4. Bracketed portion Z shows a turbulizer wherein the corrugations of strips 24 and 26, which alternate in groupings (not shown), are dimensioned to provide balanced two tier turbulizing portions.

Figure 32:
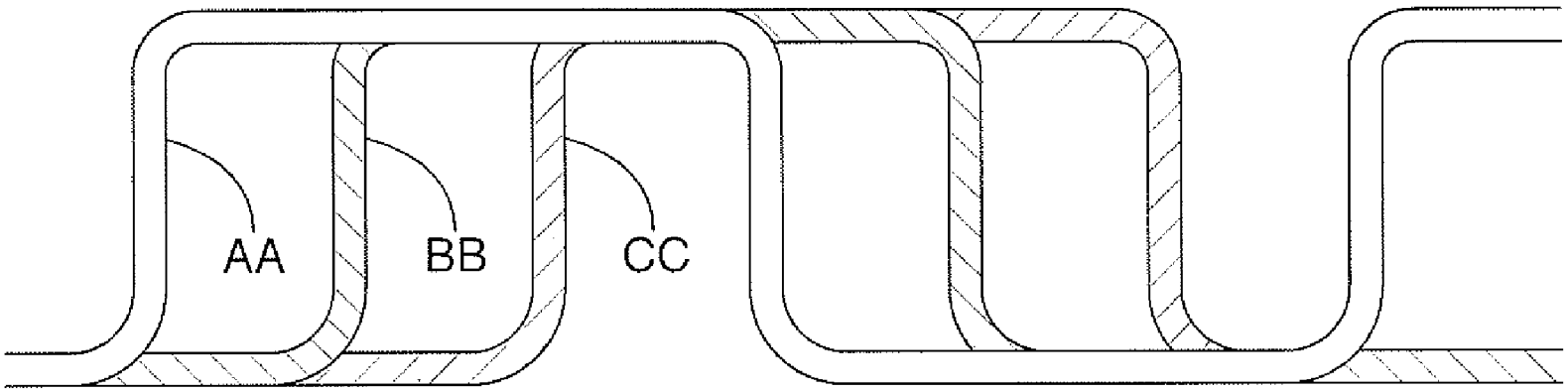
FIG. 32 is a view similar to FIG. 31 of a balanced three-tier turbulizer according to a yet further embodiment.

As well, it should be emphasized that, whereas the exemplary turbulizer is described with reference to first, second and third strips, it will be evident that turbulizers can be produced by the method with more than three different strip profiles, which may be present in any order, although as indicated, balanced turbulizers are normally most desirable. FIG. 32, for example, shows a balanced three-tier turbulizer, which would normally be constructed out of four strips, with groupings of strips AA,BB,CC,AA,BB,CC, etc. forming the turbulizing portion of the turbulizer and the fourth strip (not shown) being defined by the corrugated strip material which is fed between the dies.

In view of the foregoing, it should be understood that the present invention is limited only by the accompanying claims, purposively construed.

The invention claimed is:

1. A method of forming apparatus for use as a turbulizer or fin for a heat exchanger, the apparatus including a member having a longitudinal axis, a lateral width and a plurality of strips including one or more first strips and one or more second strips, each strip extending widthwise of the apparatus and being corrugated longitudinally so as to form a plurality of sections laterally spaced-apart from one another and connected to one another by bridges projecting from the sections in a common direction, wherein the bridges of the first strips and the second strips extend in the same direction and the corrugations of the one or more second strips are offset laterally from the corrugations of the one or more first strips, the method comprising:

crimping longitudinally-corrugated strip material between first and second forming dies to form said apparatus, said dies being adapted such that substantially all lateral movement of strip material in the crimping step occurs as a result of strip material being drawn laterally by material that has been displaced in a direction parallel to the direction of relative die movement.

2. A method according to claim 1, further characterized in that the bridges of the one or more first strips are defined by portions of the longitudinally-corrugated strip material which are not displaced during said crimping step and by portions of the longitudinally-corrugated strip material which are displaced during said crimping step.

3. A method according to claim 2, further characterized in that the bridges of the one or more second strips are defined by portions of the longitudinally-corrugated strip material which are not displaced during said crimping step and by portions of the longitudinally-corrugated strip material which are displaced during said crimping step.

4. A method according to claim 1, wherein each corrugation of said longitudinally-corrugated strip has a substantially flat surface and substantially parallel sidewalls extending substantially perpendicularly from opposite sides of the flat surface.

5. A method of forming apparatus for use as a turbulizer or fin for a heat exchanger, the apparatus including a member having a longitudinal axis, a lateral width and a plurality of strips including one or more first strips and one or more second strips, each strip extending widthwise of the apparatus and being corrugated longitudinally so as to form a plurality of sections laterally spaced-apart from one another and connected to one another by bridges projecting from the sections in a common direction with respect to each strip, wherein each of the one or more first strips and each of the one or more second strips has a profile which differs from that of the longitudinally-corrugated strip, wherein the bridges of the first strips and the second strips extend in the same direction and the corrugations of the one or more second strips are offset laterally from the corrugations of the one or more first strips, the method comprising:

crimping a longitudinally-corrugated strip between a core die and a cavity die to form said turbulizer, wherein each corrugation of said longitudinally-corrugated strip has a flat surface and parallel sidewalls extending substantially perpendicularly from opposite sides of the flat surface; and wherein each bridge of the first strip and second strip is formed by a flat surface of the core die which impinges upon and in coplanar relation with the flat surface of a respective corrugation as crimping commences.

6. A method according to claim 5, wherein: the bridges of the one or more first strips are defined by portions of the longitudinally-corrugated strip which are not displaced during said crimping step and by portions of the longitudinally-corrugated strip which are displaced during said crimping step; and the bridges of the one or more second strips are defined by portions of the longitudinally-corrugated strip which are not displaced during said crimping step and by portions of the longitudinally-corrugated strip which are displaced during said crimping step.

7. A method of forming, from a longitudinally-corrugated strip, apparatus for use as a turbulizer or fin for a heat exchanger, the apparatus including a member having a longitudinal axis, a lateral width and a plurality of strips including one or more first strips, one or more second strips and one or more third strips, each strip extending widthwise of the apparatus and being corrugated longitudinally so as to form a plurality of sections laterally spaced-apart from one another and connected to one another by bridges projecting from the sections in a common direction with respect to each strip, wherein each of the one or more first strips and the one or more second strips has a profile which differs from that of the longitudinally-corrugated strip, wherein the bridges of the first strips and the second strips extend in the same direction and the corrugations of the one or more second strips are offset laterally from the corrugations of the one or more first strips, the method comprising:

a forming step, wherein first and second forming dies move between an open position and a closed position to engage the corrugated strip between them to form said turbulizer, characterized in that substantially all lateral movement of longitudinally-corrugated strip material in the forming step occurs as a result of said strip material being drawn laterally by a laterally-connected portion of said strip material that has been displaced in a direction parallel to the direction of relative die movement.

8. A method according to claim 7, further characterized in that the bridges of the one or more first strips are defined by portions of the longitudinally-corrugated strip which are not displaced during said forming step and by portions of the longitudinally-corrugated strip which are displaced during said forming step.

9. A method according to claim 8, further characterized in that the bridges of the one or more second strips are defined by portions of the longitudinally-corrugated strip which are not displaced during said forming step and by portions of the longitudinally-corrugated strip which are displaced during said forming step.

10. A method according to claim 9, further characterized in that the one or more third strips are defined by portions of the longitudinally-corrugated strip which are not displaced during said forming step.

* * * * *